US010577870B2

(12) United States Patent
Izbinski et al.

(10) Patent No.: US 10,577,870 B2
(45) **Date of Patent: *Mar. 3, 2020**

(54) CUTTING ELEMENTS CONFIGURED TO REDUCE IMPACT DAMAGE RELATED TOOLS AND METHODS—ALTERNATE CONFIGURATIONS

(71) Applicant: Baker Hughes, Houston, TX (US)

(72) Inventors: Konrad Thomas Izbinski, The Woodlands, TX (US); Richard Wayne Borge, Houston, TX (US); Nicholas J. Lyons, Houston, TX (US); Xu Huang, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/047,863

(22) Filed: Jul. 27, 2018

(65) Prior Publication Data

US 2020/0032588 A1 Jan. 30, 2020

(51) Int. Cl.
*E21B 10/55* (2006.01)
*E21B 10/567* (2006.01)
*E21B 10/573* (2006.01)

(52) U.S. Cl.
CPC ..... *E21B 10/5673* (2013.01); *E21B 10/55* (2013.01); *E21B 10/5735* (2013.01)

(58) Field of Classification Search
CPC .... E21B 10/55; E21B 10/567; E21B 10/5673; E21B 10/5735
See application file for complete search history.

(56) References Cited

U.S. PATENT DOCUMENTS 4,987,800 A 1/1991 Gasan et al.
4,989,578 A 2/1991 Lebourg
(Continued)

FOREIGN PATENT DOCUMENTS

EP 0121083 A1 10/1984
EP 0572761 A1 12/1993
(Continued)

OTHER PUBLICATIONS

International Search Report for International Application No. PCT/US2019/043367 dated Nov. 14, 2019, 5 pages.
(Continued)

*Primary Examiner* — Matthew R Buck
(74) *Attorney, Agent, or Firm* — TraskBritt

(57) ABSTRACT

A cutting element for an earth-boring tool includes a substrate and a polycrystalline, superabrasive material secured to an end of the substrate. The polycrystalline, superabrasive material includes a first transition surface extending from an outer peripheral edge of the polycrystalline, superabrasive material and in a first direction oblique to a center longitudinal axis of the substrate and a curved, stress-reduction feature located on at least the first transition surface. Additionally, the stress-reduction feature may include an undulating edge formed in at least the first transition surface and a waveform extending from the undulating edge formed in at least the first transition surface toward the center longitudinal axis of the cutting element.

19 Claims, 12 Drawing Sheets

(56) References Cited

U.S. PATENT DOCUMENTS

| | | | | |
|---|---|---|---|---|
| 5,054,246 | A | 10/1991 | Phaal et al. | |
| 5,172,778 | A | 12/1992 | Tibbitts et al. | |
| 5,437,343 | A * | 8/1995 | Cooley | E21B 10/5673 175/431 |
| 5,709,279 | A | 1/1998 | Dennis | |
| 6,045,440 | A | 4/2000 | Johnson et al. | |
| 6,065,554 | A | 5/2000 | Taylor et al. | |
| 6,196,340 | B1 | 3/2001 | Jensen et al. | |
| 6,244,365 | B1 | 6/2001 | Southland | |
| 6,510,910 | B2 | 1/2003 | Eyre et al. | |
| 6,527,069 | B1 | 3/2003 | Meiners et al. | |
| 6,550,556 | B2 | 4/2003 | Middlemiss et al. | |
| 6,672,406 | B2 * | 1/2004 | Beuershausen | E21B 10/43 175/430 |
| 6,935,444 | B2 | 8/2005 | Lund et al. | |
| 7,475,744 | B2 | 1/2009 | Pope | |
| 7,726,420 | B2 | 6/2010 | Shen et al. | |
| 7,740,090 | B2 | 6/2010 | Shen et al. | |
| 8,037,951 | B2 | 10/2011 | Shen et al. | |
| 8,353,370 | B2 * | 1/2013 | Bellin | E21B 10/5673 175/428 |
| 8,499,860 | B2 | 8/2013 | Shen et al. | |
| 8,684,112 | B2 | 4/2014 | DiGiovanni et al. | |
| 9,062,505 | B2 | 6/2015 | Chapman et al. | |
| 9,103,174 | B2 * | 8/2015 | DiGiovanni | E21B 10/55 |
| 9,145,743 | B2 | 9/2015 | Shen et al. | |
| 9,243,452 | B2 | 1/2016 | DiGiovanni et al. | |
| 9,404,310 | B1 | 8/2016 | Sani et al. | |
| 9,428,966 | B2 | 8/2016 | Patel et al. | |
| 9,702,198 | B1 | 7/2017 | Topham | |
| 2006/0157286 | A1 | 7/2006 | Pope | |
| 2006/0219439 | A1 | 10/2006 | Shen et al. | |
| 2007/0079995 | A1 | 4/2007 | McClain et al. | |
| 2008/0205804 | A1 | 8/2008 | Jeng | |
| 2008/0236900 | A1 | 10/2008 | Cooley et al. | |
| 2009/0057031 | A1 | 3/2009 | Patel et al. | |
| 2010/0084198 | A1 | 4/2010 | Durairajan et al. | |
| 2010/0288564 | A1 | 11/2010 | Dovalina et al. | |
| 2011/0031031 | A1 | 2/2011 | Vempati et al. | |
| 2011/0088950 | A1 | 4/2011 | Scott et al. | |
| 2011/0155472 | A1 | 6/2011 | Lyons et al. | |
| 2011/0171414 | A1 | 7/2011 | Sreshta et al. | |
| 2011/0259642 | A1 | 10/2011 | DiGiovanni et al. | |
| 2011/0286810 | A1 | 11/2011 | Lancaster et al. | |
| 2012/0247834 | A1 | 10/2012 | Buxbaum et al. | |
| 2012/0325563 | A1 | 12/2012 | Scott et al. | |
| 2013/0068534 | A1 | 3/2013 | Digiovanni et al. | |
| 2013/0068537 | A1 | 3/2013 | DiGiovanni | |
| 2013/0068538 | A1 | 3/2013 | DiGiovanni et al. | |
| 2014/0041948 | A1 | 2/2014 | Shen et al. | |
| 2014/0238753 | A1 | 8/2014 | Nelms et al. | |
| 2014/0246253 | A1 | 9/2014 | Patel et al. | |
| 2015/0047913 | A1 * | 2/2015 | Durairajan | E21B 10/55 175/428 |
| 2015/0259988 | A1 * | 9/2015 | Chen | E21B 10/5673 175/430 |
| 2015/0285007 | A1 | 10/2015 | Stockey et al. | |
| 2016/0069140 | A1 | 3/2016 | Patel et al. | |
| 2016/0265285 | A1 * | 9/2016 | Stockey | E21B 10/5673 |
| 2018/0320450 | A1 * | 11/2018 | Borge | E21B 10/5676 |
| 2019/0071933 | A1 * | 3/2019 | Gan | E21B 10/5676 |
| 2019/0084087 | A1 * | 3/2019 | Chapman | B23K 26/3568 |

FOREIGN PATENT DOCUMENTS

| | | | |
|---|---|---|---|
| EP | 0893572 | B1 | 12/2003 |
| GB | 2369841 | | 12/2004 |
| JP | 11-060667 | A | 3/1999 |
| JP | 2008-291222 | A | 12/2008 |
| JP | 5315838 | B2 | 10/2013 |
| WO | 97/30263 | A1 | 8/1997 |
| WO | 00/48789 | A1 | 8/2000 |
| WO | 2004/007901 | A1 | 1/2004 |
| WO | 2004/007907 | A1 | 1/2004 |
| WO | 2008/102324 | A1 | 8/2008 |
| WO | 2016/044136 | A1 | 3/2016 |

OTHER PUBLICATIONS

International Written Opinion for International Application No. PCT/US2019/043367 dated Nov. 14, 2019, 7 pages.

* cited by examiner

CUTTING ELEMENTS CONFIGURED TO REDUCE IMPACT DAMAGE RELATED TOOLS AND METHODS—ALTERNATE CONFIGURATIONS

RELATED APPLICATION

The present application is related to the subject matter of co-pending U.S. patent application Ser. No. 16/047,819, "CUTTING ELEMENTS CONFIGURED TO REDUCE IMPACT DAMAGE AND MITIGATE POLYCRYSTALLINE, SUPERABRASIVE MATERIAL FAILURE EARTH-BORING TOOLS INCLUDING SUCH CUTTING ELEMENTS, AND RELATED METHODS," filed on even date herewith, the entire disclosure of which is hereby incorporated herein by this reference. The present application is also related to the subject matter of U.S. patent application Ser. No. 15/584,943, filed on May 2, 2017, now U.S. Pat. No. 10,400,517, issued Sept. 3, 2019.

FIELD

This disclosure relates generally to cutting elements for earth-boring tools, to earth-boring tools carrying such cutting elements, and to related methods. More specifically, disclosed embodiments relate to cutting elements for earth-boring tools that may better resist impact damage, induce beneficial stress states within the cutting elements, and improve cooling of the cutting elements.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on a body a drill bit by brazing. The drill bit body is formed with recesses therein, commonly termed "pockets," for receiving a substantial portion of each cutting element in a manner which presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting clement via a torch to raise the temperature to a point high enough to braze the cutting elements to the bit body in a fixed position but not so high as to damage the PCD layer. The cutting elements are conventionally fixed in place, such as, for example, by brazing the cutting elements within pockets formed in the rotationally leading portions of the blades. Because formation material removal exposes the formation-engaging portions of the cutting tables to impacts against the subterranean formations, the cutting elements may chip, which dulls the impacted portion of the cutting element or even spall, resulting in loss of substantial portions of the table. Continued use may wear away that portion of the cutting table entirely, leaving a completely dull surface that is ineffective at removing earth material.

BRIEF SUMMARY

Some embodiments of the present disclosure include a cutting element for an earth-boring tool. The cutting element may include a substrate and a polycrystalline, superabrasive material secured to an end of the substrate. The polycrystalline, superabrasive material may include a first transition surface extending from an outer peripheral edge of the polycrystalline, superabrasive material and in a first direction oblique to a center longitudinal axis of the substrate and a curved, stress-reduction feature located on at least the first transition surface.

Further embodiments of the present disclosure include an earth-boring tool. The earth-boring tool may include a body and a cutting element secured to the body. The cutting element may include a substrate and a polycrystalline, superabrasive material secured to an end of the substrate. The polycrystalline, superabrasive material may include a first transition surface extending from an outer peripheral edge of the polycrystalline, superabrasive material and in a first direction oblique to a center longitudinal axis of the substrate and a curved, stress-reduction feature located on at least the first transition surface. The curved, stress-reduction feature may include an undulating edge formed in at least the first transition surface and a waveform extending from the undulating edge formed in at least the first transition surface toward the center longitudinal axis of the substrate.

Additional embodiments of the present disclosure include a method of forming a cutting element for an earth-boring tool. The method may include attaching a polycrystalline, superabrasive material to a substrate, forming a first transition surface to extend from an outer peripheral edge of the polycrystalline, superabrasive material and in a first direction oblique to a center longitudinal axis of the substrate, and forming a curved, stress-reduction feature on at least the first transition surface. The curved, stress-reduction feature may include an undulating edge formed in at least the first transition surface and a waveform extending from the undulating edge formed in at least the first transition surface toward the center longitudinal axis of the substrate.

DETAILED DESCRIPTION

Figure 1:
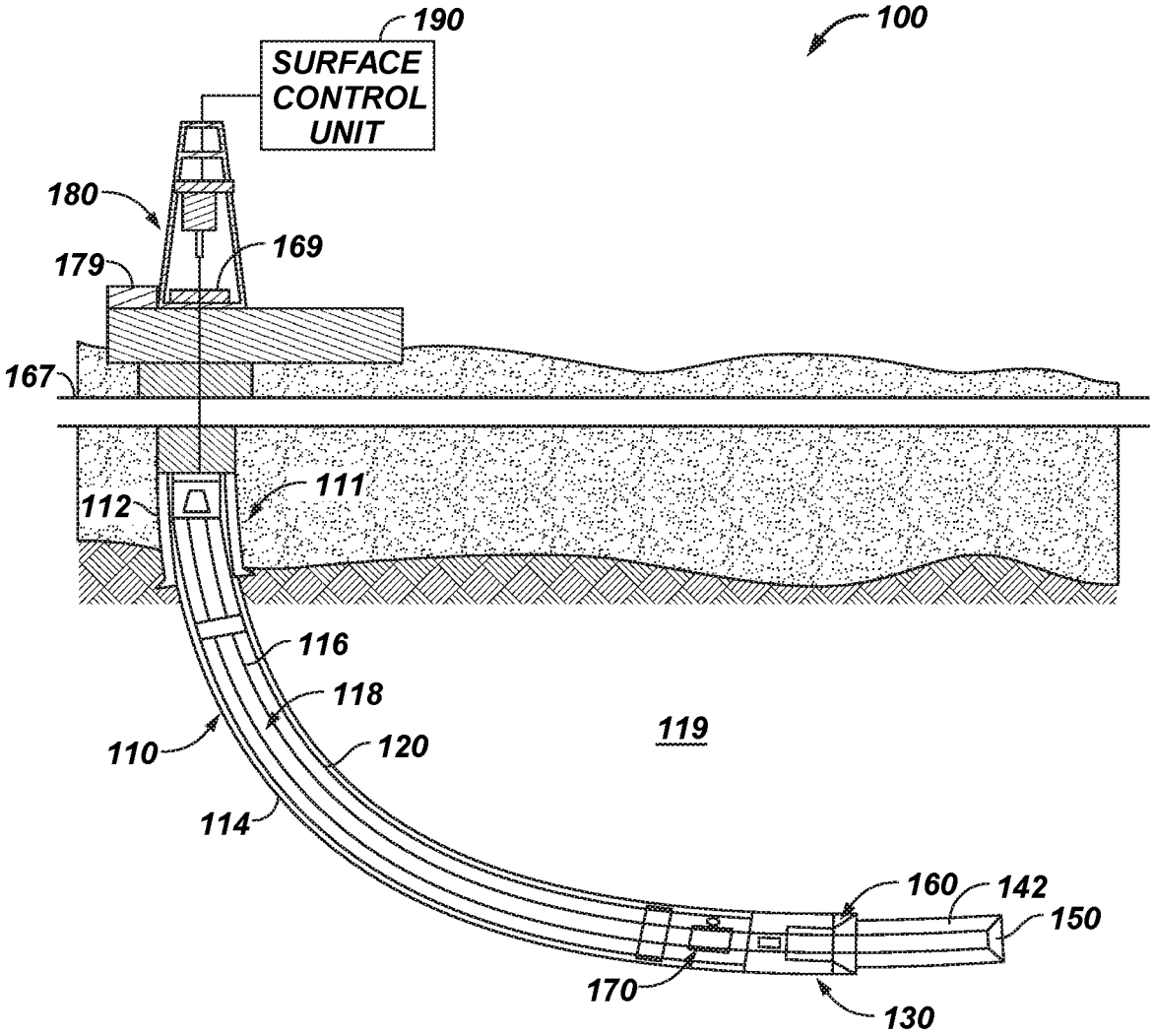
FIG. 1 is a simplified schematic diagram of an example of a drilling system using cutting element assemblies according to one or more embodiments of the present disclosure.

The illustrations presented herein are not actual views of any particular cutting element, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "below," "lower," "bottom," "above," "upper," "top," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $kg/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "tungsten carbide" means any material composition that contains chemical compounds of tungsten and carbon, such as, for example, WC, $W_2C$, and combinations of WC and $W_2$ C. Tungsten carbide includes, for example, cast tungsten carbide, sintered tungsten carbide, and macrocrystalline tungsten carbide.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that may include an upper section 111 with a casing 112 installed therein and a lower section 114 that is being drilled with a drill string 118. The drill string 118 may include a tubular member 116 that carries a drilling assembly 130 at its bottom end. The tubular member 116 may be coiled tubing or may be formed by joining drill pipe sections. A drill bit 150 (also referred to as the "pilot bit") may be attached to the bottom end of the drilling assembly 130 for drilling a first, smaller diameter borehole 142 in the formation 119. A reamer bit 160 may be placed above or uphole of the drill bit 150 in the drill string to enlarge the borehole 142 to a second, larger diameter borehole 120. The terms wellbore and borehole are used herein as synonyms.

The drill string 118 may extend to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively form boreholes 142 and 120. The rig 180 may also include conventional devices, such as mechanisms to add additional sections to the tubular member 116 as the wellbore 110 is drilled. A surface control unit 190, which may be a computer-based unit, may be placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 may rotate. The pilot bit 150 drills the first, smaller diameter borehole 142, while simultaneously the reamer bit 160 enlarges the borehole 142 to a second, larger diameter borehole 120. The earth's subsurface formation may contain rock strata made up of different rock structures that can vary from soft formations to very hard formations, and therefore the pilot bit 150 and/or the reamer bit 160 may be selected based on the formations expected to be encountered in a drilling operation.

Figure 2:
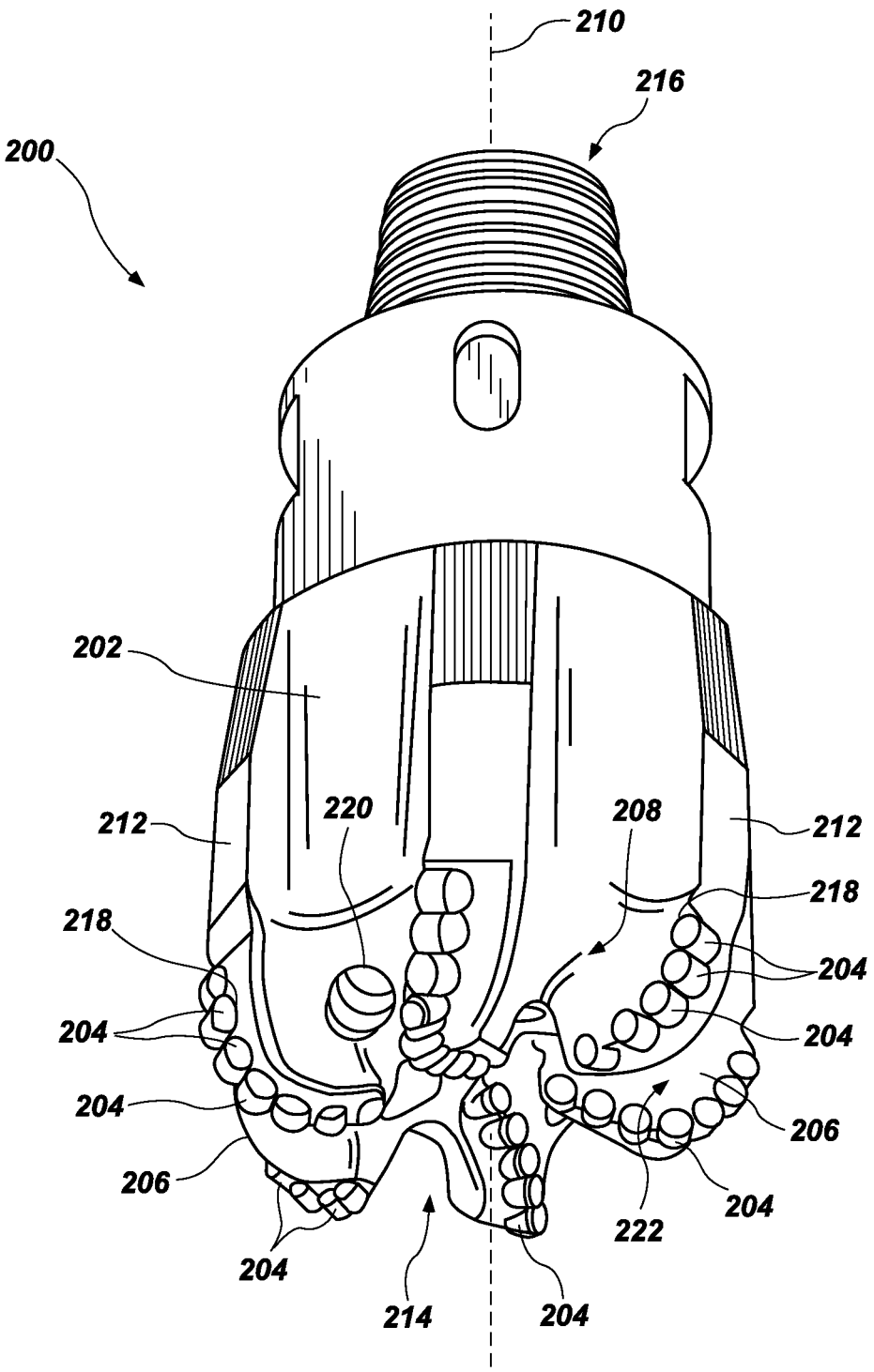
FIG. 2 is a simplified perspective view of an earth-boring tool that may be used in conjunction with the drilling system of FIG. 1.

Referring to FIG. 2, a perspective view of an earth-boring tool 200 is shown. The earth-boring tool 200 may include a body 202 having cutting elements 204 secured to the body 202. The earth-boring tool 200 shown in FIG. 2 may be configured as a fixed-cutter drill bit, but other earth-boring tools having cutting elements 204 secured to a body may be employed, such as, for example, those discussed previously in connection with the term "earth-boring tool." The earth-boring tool 200 may include blades 206 extending outward from a remainder of the body 202, with junk slots 208 being located rotationally between adjacent blades 206. The blades 206 may extend radially from proximate an axis of rotation 210 of the earth-boring tool 200 to a gage region 212 at a periphery of the earth-boring tool 200. The blades 206 may extend longitudinally from a face 214 at a leading end of the earth-boring tool 200 to the gage region 212 at the periphery of the earth-boring tool 200. The earth-boring tool 200 may include a shank 216 at a trailing end of the earth-boring tool 200 longitudinally opposite the face 214. The shank 216 may have a threaded connection portion, which may conform to industry standards (e.g., those promulgated by the American Petroleum Institute (API)), for attaching the earth-boring tool 200 to a drill string.

The cutting elements 204 may be secured within pockets 218 formed in the blades 206. Nozzles 220 located in the junk slots 208 may direct drilling fluid circulating through the drill string toward the cutting elements 204 to cool the cutting elements 204 and remove cuttings of earth material. The cutting elements 204 may be positioned to contact, and remove, an underlying earth formation in response to rotation of the earth-boring tool 200 when weight is applied to the earth-boring tool 200. For example, cutting elements 204 in accordance with this disclosure may be primary or secondary cutting elements (i.e., may be the first or second surface to contact an underlying earth formation in a given cutting path), and may be located proximate the rotationally leading surface 222 of a respective blade 206 or may be secured to the respective blade 206 in a position rotationally trailing the rotationally leading surface 222.

Figure 3A:
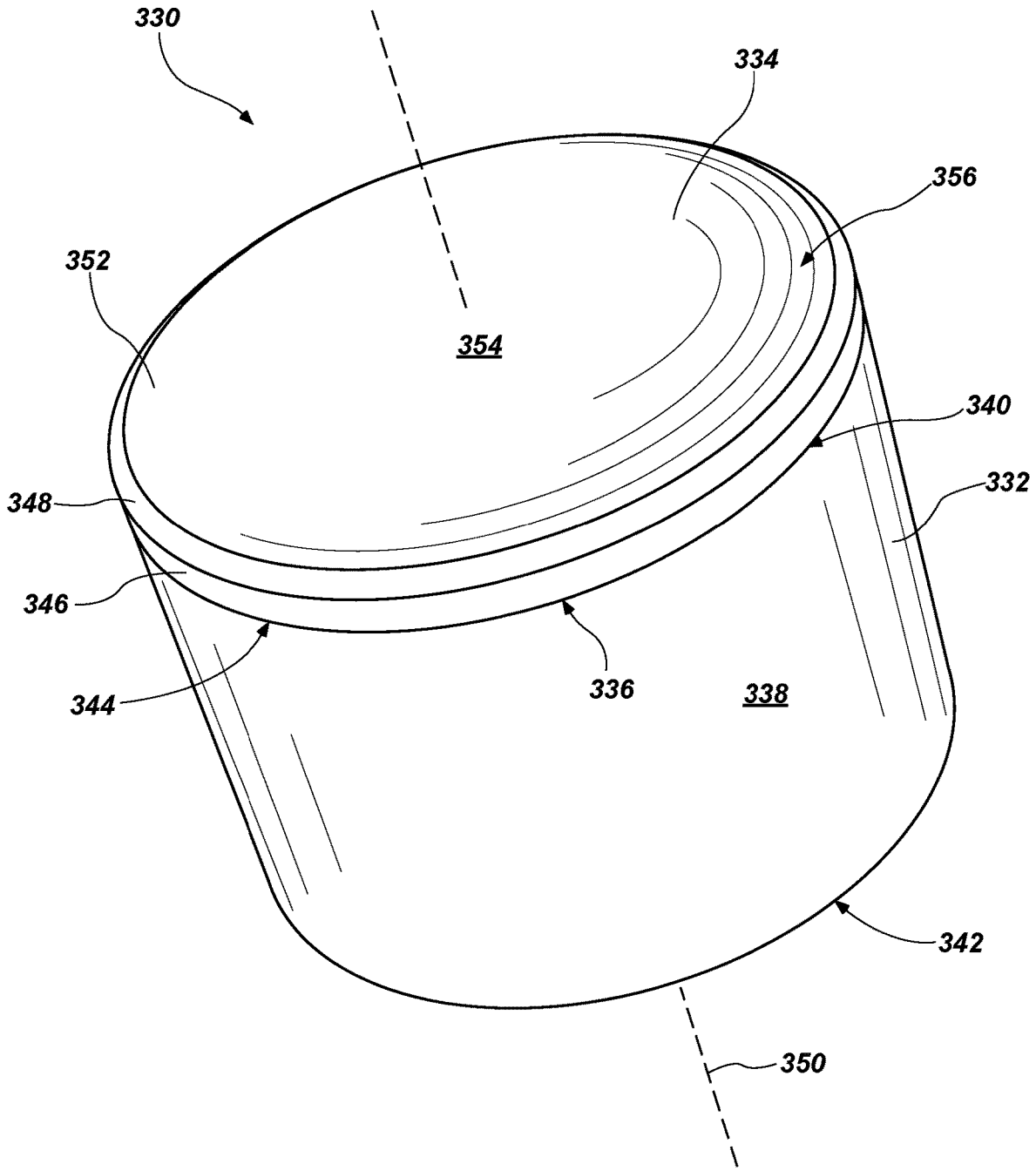
FIG. 3A is a perspective view of a cutting element usable with the earth-boring tool of FIG. 2 according to one or more embodiments of the present disclosure.

FIG. 3A is a perspective view of an embodiment of a cutting element 330 usable with the earth-boring tool 200 of FIG. 2. The cutting element 330 may include a substrate 332 (e.g., a base portion) and a table of polycrystalline, superabrasive material 334 (e.g., an upper portion) secured to an end 336 of the substrate 332. More specifically, the polycrystalline, superabrasive material 334 may be a polycrystalline diamond compact (PDC). The substrate 332 may be generally cylindrical in shape. For example, the substrate 332 may include a curved side surface 338 extending around a periphery of the substrate 332 and end surfaces 340 and 342. In some embodiments, the end surfaces 340 and 342 may have a circular or oval shape, for example. The end surfaces 340 and 342 may be, for example, planar or nonplanar. For instance, the end surface 340 forming an interface between the substrate 332 and the polycrystalline, superabrasive material 334 may be nonplanar.

In some embodiments, the substrate 332 may include a chamfer transitioning between the curved side surface 338 and one or more of the end surfaces 340 and 342, typically between curved side surface 338 and end surface 342. The substrate 332 may have a center longitudinal axis 350 extending parallel to the curved side surface 338 through geometric centers of the end surfaces 340 and 342. The substrate 332 may include hard, wear-resistant materials suitable for use in a downhole drilling environment. For example, the substrate 332 may include metal, metal alloys, ceramic, and/or metal-ceramic composite (i.e., "cermet") materials. As a specific, non-limiting example, the substrate 332 may include a cermet including particles of tungsten carbide cemented in a metal or metal alloy matrix.

The polycrystalline, superabrasive material 334 may include an interfacial surface 344 abutting, and secured to, the end surface 340 of the substrate 332. The polycrystalline, superabrasive material 334 may be generally disc-shaped, and may include a side surface 346 extending longitudinally from the interfacial surface 344 away from the substrate 332. The side surface 346 may be curved, and may be, for example, flush with the curved side surface 338 of the substrate 332.

The polycrystalline, superabrasive material 334 may include a first transition surface 348 (e.g., a primary chamfer) extending from the side surface 346 away from the substrate 332. The first transition surface 348 may have a frustoconical shape, and may comprise what is often referred to in the art as a "chamfer" surface. The first transition surface 348 may extend away from the substrate 332 in a first direction oblique to a center longitudinal axis 350 of the substrate 332. Additionally, the first transition surface 348 may extend radially from the side surface 346 at the periphery of the polycrystalline, superabrasive material 334 inward toward the center longitudinal axis 350. In some embodiments, the polycrystalline, superabrasive material 334 may lack the side surface 346, such that the first transition surface 348 may begin at an intersection (e.g., an edge) with the interfacial surface 344 located adjacent to the end surface 340 of the substrate 332.

In some embodiments, the polycrystalline, superabrasive material 334 may further include a second transition surface 352 (e.g., a secondary chamfer) extending from the first transition surface 348 away from the substrate 332. For example, the polycrystalline, superabrasive material 334 may include any of the second transition surfaces described in U.S. patent application Ser. No. 15/584,943, to Borge, filed May 2, 2017, the disclosure of which is incorporated in its entirety by reference herein. For instance, the second transition surface 352 may extend away from the substrate 332 in a second direction oblique to the center longitudinal axis 350 of the substrate 332. The second direction in which the second transition surface 352 extends may be different from the first direction in which the first transition surface 348 extends. The second transition surface 352 may extend radially from the first transition surface 348 at the radially innermost extent thereof inward toward the center longitudinal axis 350. For example, the second transition surface 352 may extend radially inward more rapidly than the first transition surface 348.

In some embodiments, such as that shown in FIG. 3A, the polycrystalline, superabrasive material 334 may include a cutting face 354 extending from either the first transition surface 348 or the second transition surface 352 radially inward to the center longitudinal axis 350. The cutting face 354 may extend, for example, in a direction perpendicular to the center longitudinal axis 350. Each of the first transition surface 348, the second transition surface 352, and the cutting face 354 may have a cross-sectional shape at least substantially similar to, though smaller in a radial extent than, a cross-sectional shape of the curved side surface 338 and side surface 346 of the substrate 332 and the polycrystalline, superabrasive material 334.

In some embodiments, the cutting face 354 may exhibit a different degree of roughness than a remainder of the exposed surfaces of the polycrystalline, superabrasive material 334. For example, the cutting face 354 may be rougher than (e.g., may be polished to a lesser degree or with a less fine polish) the remainder of the exposed surfaces of the polycrystalline, superabrasive material 334. More specifically, a difference in surface roughness between the cutting face 354 and the remainder of the exposed surfaces of the polycrystalline, superabrasive material 334 may be, for example, between about 1 μin Ra and about 30 μin Ra. Ra may be defined as the arithmetic average of the absolute values of profile height deviations from the mean line, recorded within an evaluation length. Stated another way, Ra is the average of a set of individual measurements of a surface's peaks and valleys. As a specific, non-limiting example, the difference in surface roughness between the cutting face 354 and the remainder of the exposed surfaces of the polycrystalline, superabrasive material 334 may be between about 20 μin Ra and about 25 μin Ra. As continuing examples, a surface roughness of the cutting face 354 may be between about 20 μin Ra and about 40 μin Ra, and a surface roughness of the remainder of the exposed surface of the polycrystalline, superabrasive material 334 may be between about 1 μin Ra and about 10 μin Ra. More specifically, the surface roughness of the cutting face 354 may be, for example, between about 20 μin Ra and about 30 μin Ra, and the surface roughness of the remainder of the exposed surface of the polycrystalline, superabrasive material 334 may be, for example, between about 1 μin Ra and about 7 μin Ra. As specific, non-limiting examples, a surface roughness of the cutting face 354 may be between about 22 μin Ra and about 27 μin Ra (e.g., about 25 μin Ra), and a surface roughness of the remainder of the exposed surface of the polycrystalline, superabrasive material 334 may be between about 1 μin Ra and about 5 μin Ra (e.g., about 1 μin Ra). The change in direction from the second transition surface 352 to the cutting face 354, and the optional change in roughness in certain embodiments, may cause cuttings produced by the cutting element 330 to break off, acting as a chip breaker.

By increasing the number of transition surfaces relative to a cutting element with a single chamfer, the cutting element 330 may increase the time over which an impulse resulting from contact with an earth formation may act on the cutting element. As a result, the cutting element 330 may reduce peak collision force, reducing impact and chip damage and increasing the useful life of the cutting element 330.

As is discussed in greater detail below, in some embodiments, the cutting element 330 may further include a curved, stress-reduction feature formed and located on at least the first transition surface 348. The curved, stress-reduction feature may be sized and shaped to induce a beneficial stress state within the polycrystalline, superabrasive material 334. More specifically, the curved-stress-reduction feature may reduce the likelihood that tensile stresses will occur, and may reduce the magnitude of any tensile stresses that appear, in the polycrystalline, superabrasive material.

Figure 3B:
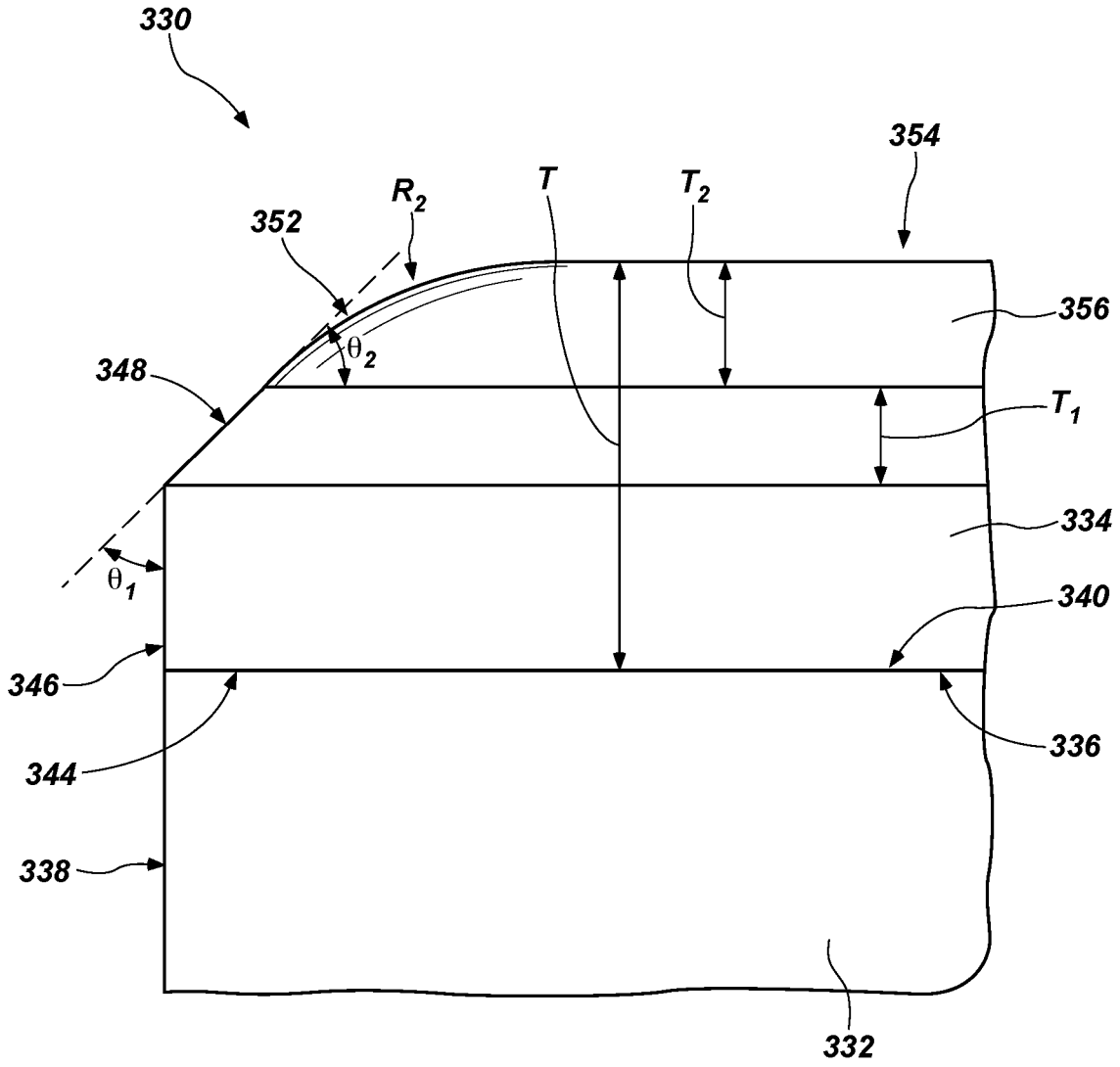
FIG. 3B is a side view of a portion of the cutting element of FIG. 3A.

FIG. 3B is a side view of a portion of the cutting element 330 of FIG. 3A. As shown in FIGS. 3A and 3B, the first transition surface 348 may be a chamfered surface in some embodiments. For example, the first transition surface 348 may extend at a constant slope from the side surface 346 toward the center longitudinal axis 350. More specifically, a first acute angle $\theta_1$ between the first transition surface 348 and the center longitudinal axis 350 may be, for example, between about 30° and about 60° . As a specific, non-limiting example, the first acute angle $\theta_1$ between the first transition surface 348 and the center longitudinal axis 350 may be between about 40° and about 50° (e.g., about 45° ). A first thickness $T_1$ of the first transition surface 348 as measured in a direction parallel to the center longitudinal axis 350 may be, for example, between about 5% and about 20% of a total thickness T of the polycrystalline, superabrasive material 334 as measured in the same direction. More specifically, the first thickness $T_1$ of the first transition surface 348 may be, for example, between about 7% and about 15% of the total thickness T of the polycrystalline, superabrasive material 334. As a specific, non-limiting example, the first thickness $T_1$ of the first transition surface 348 may be between about 8% and about 12% (e.g., about 10%) of the total thickness T of the polycrystalline, superabrasive material 334. The first thickness $T_1$ of the first transition surface 348 may be, as another example, between about 0.20 mm and about 0.53 mm. More specifically, the first thickness $T_1$ of the first transition surface 348 may be, for example, between about 0.38 mm and about 0.43 mm. As a specific, non-limiting example, the first thickness $T_1$ of the first transition surface 348 may be about 0.41 mm.

In some embodiments, the second transition surface 352 may be a truncated dome shape in some embodiments, such as that shown in FIGS. 3A and 3B. For example, a slope of the second transition surface 352 may change at least substantially continuously, and at an at least substantially constant rate, from the first transition surface 348 to the cutting face 354. More specifically, a radius of curvature $R_2$ of the second transition surface 352 may be, for example, between about 0.50 mm and about 3.3 mm. As a specific, non-limiting example, the radius of curvature $R_2$ of the second transition surface 352 may be, for example, between about 1.52 mm and about 2.54 mm (e.g., about 2.0 mm). A second thickness $T_2$ of the second transition surface 352 as measured in a direction parallel to the center longitudinal axis 350 may be greater than the first thickness $T_1$ of the first transition surface 348 and may be, for example, between about 5% and about 50% of the total thickness T of the polycrystalline, superabrasive material 334 as measured in the same direction. More specifically, the second thickness $T_2$ of the second transition surface 352 may be, for example, between about 15% and about 45% of the total thickness T of the polycrystalline, superabrasive material 334. As a specific, non-limiting example, the second thickness $T_2$ of the second transition surface 352 may be between about 20% and about 35% (e.g., about 30%) of the total thickness T of the polycrystalline, superabrasive material 334. The second thickness $T_2$ of the second transition surface 352 may be, as another example, between about 0.25 mm and about 1.27 mm. More specifically, the second thickness $T_2$ of the second transition surface 352 may be, for example, between about 0.50 mm and about 1.02 mm. As a specific, non-limiting example, the second thickness $T_2$ of the second transition surface 352 may be about 0.76 mm.

In additional embodiments, the second transition surface 352 may be a chamfered surface. For example, the second transition surface 352 may extend at a constant slope from the first transition surface 348 toward the center longitudinal axis 350. In one or more embodiments, the slope of the second transition surface 352 (e.g., at least an initial portion of the second transition surface 352 when the second transition surface 352 comprises a truncated dome) may define a second acute angle $\theta_2$ relative to a plane to which the center longitudinal axis 350 of the cutting element 330 is normal. In some embodiments, the second acute angle $\theta_2$ may be within a range of about 0° and about 60° . As a non-limiting example, the second acute angle $\theta_2$ may be within a range of about 0° and about 30° . As will be appreciated by one of ordinary skill in the art, when the second acute angle $\theta_2$ is equal to 0° , the cutting element 330 does not include a second transition surface 352. Selecting the second acute angle $\theta_2$ enables an aggressiveness of the cutting element 330 to be selected.

Although the cutting element 330 is described above as including both a first transition surface 348 and a second transition surface 352, the disclosure is not so limited. Rather, in some embodiments, the cutting element 330 may only include the first transition surface 348 (i.e., only one transition surface). For instance, including both the first transition surface 348 and the second transition surface 352 is not required in every embodiment.

Figure 4:
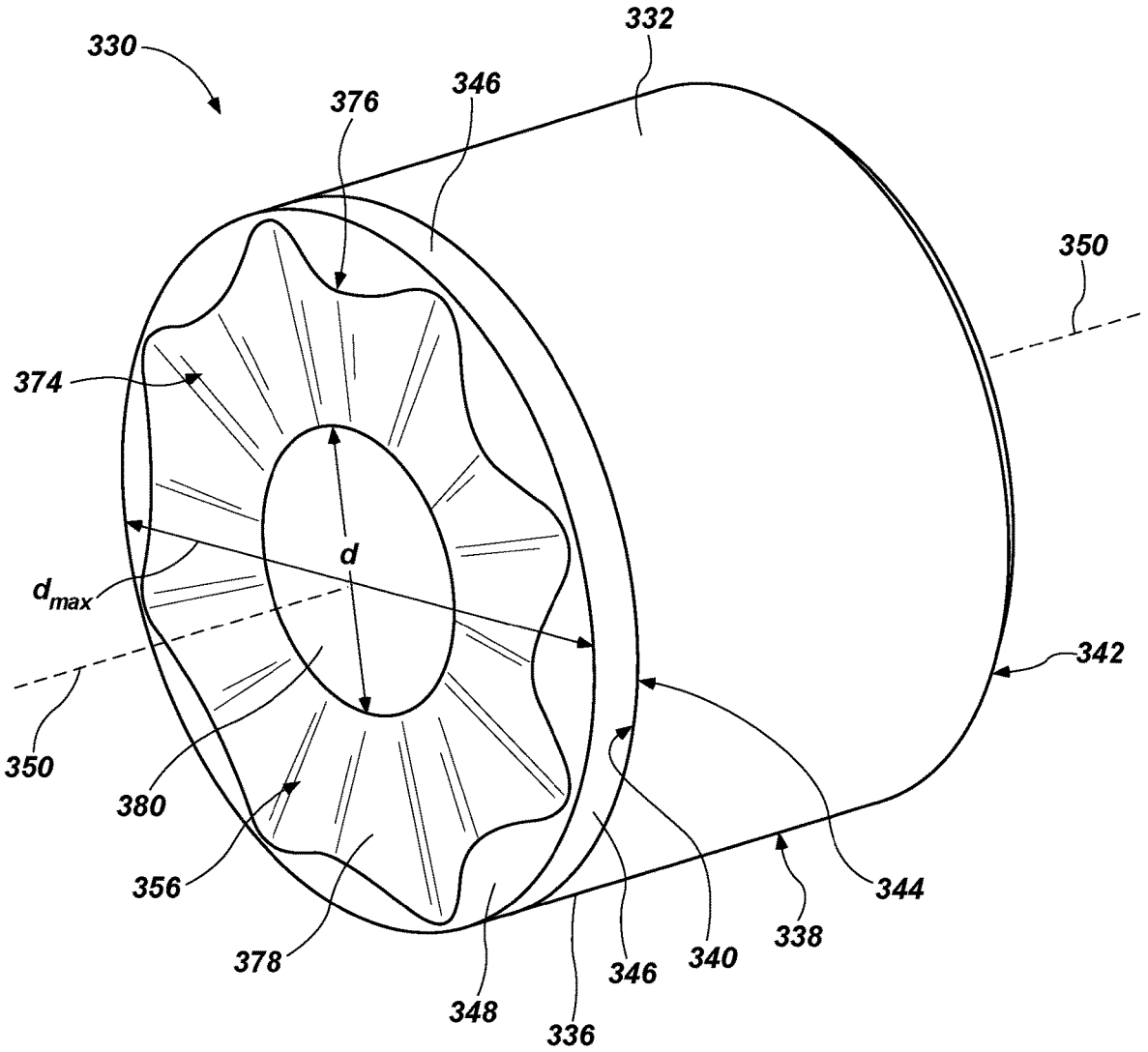
FIG. 4 is a perspective view of another cutting element usable with the earth-boring tool of FIG. 2 according to one or more embodiments of the present disclosure.

FIG. 4 is a perspective view of a cutting element 330 usable with the earth-boring tool 200 of FIG. 2 according to one or more embodiments of the present disclosure. As shown in FIG. 4, in some embodiments, the curved, stress-reduction feature 356 may include a waveform 374 formed in at least the first transition surface 348 (e.g., the primary chamfer) of the cutting element 330. More specifically, the first transition surface 348 may extend from the side surface 346 of the substrate 332 to an undulating edge 376 at a longitudinally uppermost extent of the first transition surface 348 farthest from the substrate 332. The undulating edge 376 may exhibit, for example, a sinusoidal shape. A surface 378 of the waveform 374 may extend from the undulating edge 376 radially inward toward the center longitudinal axis 350 of the cutting element 330. Furthermore, due to the sinusoidal shape of the undulating edge 376, the surface 378 of the waveform 374 may define a plurality of troughs and a plurality of peaks. The surface 378 of the waveform 374 may also extend longitudinally from the undulating edge 376 toward or away from the substrate 332, such that the surface 378 extends in a third direction oblique to the center longitudinal axis 350. More specifically, in some embodiments, the troughs of the waveform 374 may extend in a radial direction perpendicular to the center longitudinal axis 350, and the peaks of the waveform 374 may extend in a radial direction oblique to the center longitudinal axis 350, such that the height of the peaks decreases as a radial distance from the center longitudinal axis 350 decreases. In additional embodiments, the peaks of the waveform 374 may extend in a radial direction perpendicular to the center longitudinal axis 350, and the troughs of the waveform 374 may extend in a radial direction oblique to the center longitudinal axis 350, such that the depth of the troughs decreases as a radial distance from the center longitudinal axis 350 decreases.

In some embodiments, the undulating edge 376 may define a radially innermost edge of the first transition surface 348. For instance, the undulating edge 376 may undulate inward and outward radially relative to the center longitudinal axis 350 of the cutting element 330.

In embodiments including a second transition surface 352, the stress-reduction feature 356 may extend from the first transition surface 348 and into the second transition surface 352. For example, in some embodiments, the undulating edge 376 and undulate back and forth between the first transition surface 348 and the second transition surface 352. Additionally, in some embodiments, the undulating edge 376 may extend completely through the second transition surface 352 and into a planar surface of the cutting element 330. Moreover, in one or more embodiments, the undulating edge 376 may intersect the edge defined at the intersection between the first transition surface 348 and the side surface 346. In alternative embodiments the undulating edge 376 may be spaced apart from the edge defined at the intersection between first transition surface 348 and the side surface 346 by at least some distance.

As the surface 380 of the waveform 374 extends radially inward, the surface 378 of the waveform 374 may intersect with a planar surface 380 extending perpendicular to, and intersected by, the center longitudinal axis 350. The planar surface 380 may be located, for example, in the same position along the center longitudinal axis 350 as the edge defined at the intersection between the first transition surface 348 and the side surface 346. In other embodiments, the planar surface 380 may be located at a different position along the center longitudinal axis 350 as the edge defined at the intersection between the first transition surface 348 and the side surface 346. A diameter d of the planar surface 380 may be, for example, between about 10% and about 50% of a maximum diameter $d_{max}$ of the polycrystalline, superabrasive material 334. More specifically, the diameter d of the planar surface 380 may be, for example, between about 20% and about 40% of the maximum diameter $d_{max}$ of the polycrystalline, superabrasive material 334. As a specific, non-limiting example, the diameter d of the planar surface 380 may be, for example, between about 25% and about 35% (e.g., about 30%) of the maximum diameter $d_{max}$ of the polycrystalline, superabrasive material 334. In some embodiments, the planar surface 380 may exhibit a different degree of roughness than a remainder of the exposed surfaces of the polycrystalline, superabrasive material 334. For example, the planar surface 380 may be rougher than (e.g., may be polished to a lesser degree or with a less fine polish) the remainder of the exposed surfaces of the polycrystalline, superabrasive material 334. The change in direction from the surface 378 of the waveform 374 to the planar surface 380, and the optional change in roughness in certain embodiments, may cause cuttings produced by the cutting element 330 to break off, acting as a chip breaker.

A frequency of the waveform 374 may be, for example, between about one peak every 180° and about ten peaks every 90° . More specifically, the frequency of the waveform 374 may be, for example, between about two peaks every 90° and about eight peaks every 90° . As a specific, non-limiting example, the frequency of the waveform 374 may be, for example, between about three peaks every 90° and about seven peaks every 90° (e.g., about five peaks every 90° ).

In embodiments where the cutting element 330 includes a waveform 374, such as that shown in FIG. 4, the first portion of the cutting element 330 to contact an underlying earth formation may be the peak or peaks of the waveform 374 that are being forced into the earth formation by applied weight on the earth-boring tool 200 (FIG. 2). As a result, the surface area that initially contacts the earth formation may be reduced, which may increase the stress induced in the earth formation to better initiate and propagate cracks therein. Additionally, the waveform 374 may induce beneficial stress states within the cutting element 330, and the waveform 374 may increase fluid flow across the polycrystalline, superabrasive material 334, improving cooling and facilitating removal of cuttings. In view of the foregoing, the stress-reduction feature 356 may improve an overall durability of the cutting face 354 of the cutting element 330 and may reduce wear experienced by the cutting face 354 of the cutting element 330.

Figure 5:
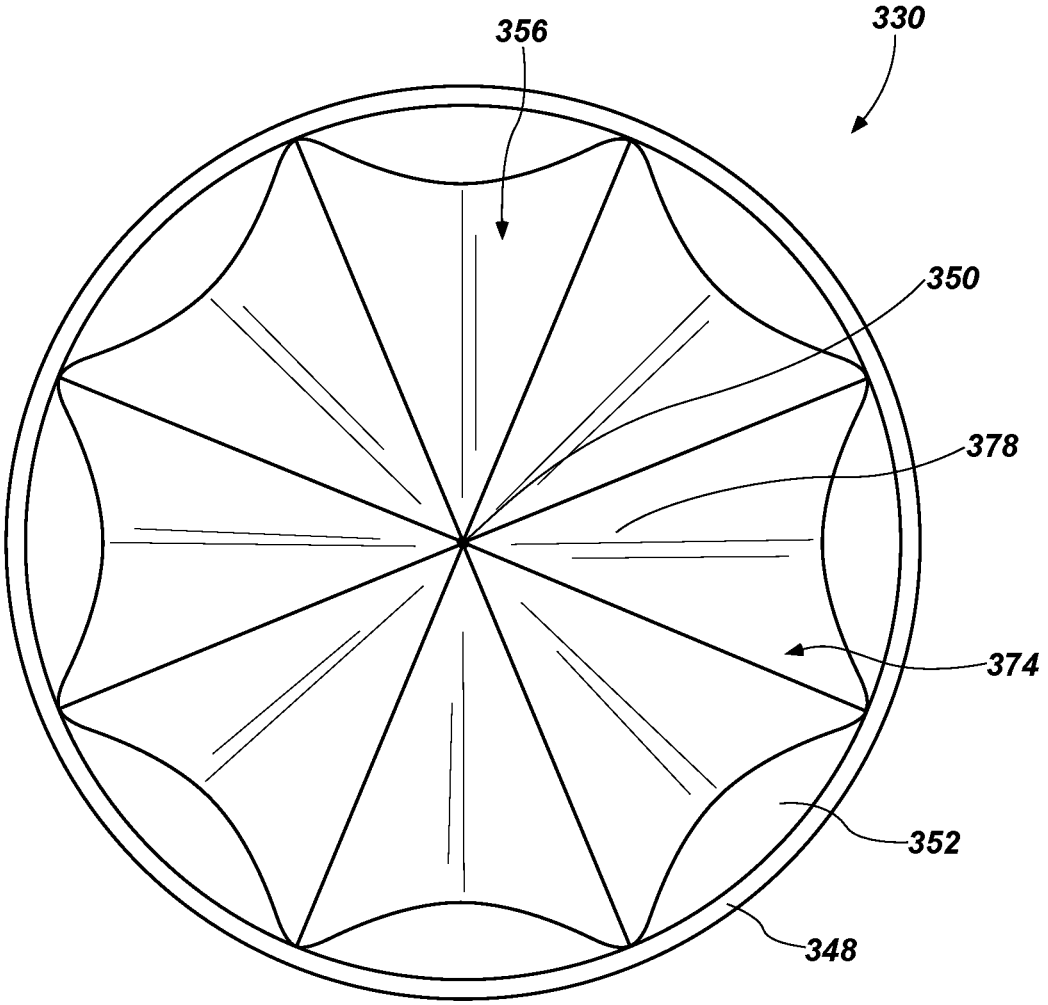
FIG. 5 is a front side view of another cutting element usable with the earth-boring tool of FIG. 2 according to one or more embodiments of the present disclosure.

FIG. 5 is a front view of a cutting element 330 according to one or more additional embodiments of the present disclosure. As shown in FIG. 5, the surface 378 of the waveform 374 of the stress-reduction feature 356 may extend to (e.g., all the way to) the center longitudinal axis 350 of the cutting element 330. In other words, in the embodiments depicted in FIG. 5, the cutting element 330 may not include a planar surface extending perpendicular to, and intersected by, the center longitudinal axis 350. In some embodiments, a meeting point of the waves of the waveform 374 may be recessed relative to the first and/or second transition surfaces 348, 352. In additional embodiments, the meeting point of the waves of the waveform 374 may be projected axially outward relative to the rest of the waveform 374 and/or the first and/or second transition surfaces 348, 352.

Having the surface 378 of the waveform 374 extend to the center longitudinal axis 350 of the cutting element 330 may result in reduced side loads on portions of the cutting element 330 and vibrations experienced by the cutting element 330 during drilling operations. As a result, having the surface 378 of the waveform 374 extend to the center longitudinal axis 350 may improve an overall durability of the cutting element 330. Furthermore, having the surface 378 of the waveform 374 extend to the center longitudinal axis 350 of the cutting element 330 may reduce distances of spalls and fractures that may result in the waveform 374 and stress-reduction feature 356 during drilling processes. Moreover, having the surface 378 of the waveform 374 extend to the center longitudinal axis 350 of the cutting element 330 may result in less required weight on bit at high depths of cut of the earth-boring tool 200 (FIG. 2). In other words, the cutting element 330 may be more efficient. Likewise, having the surface 378 of the waveform 374 extend to the center longitudinal axis 350 of the cutting element 330 may change an angle of the waveform 374 transitioning to the center longitudinal axis 350 and may more effectively distribute loads experienced by the surface 378 and may cause a reduction in stress.

Figure 6:
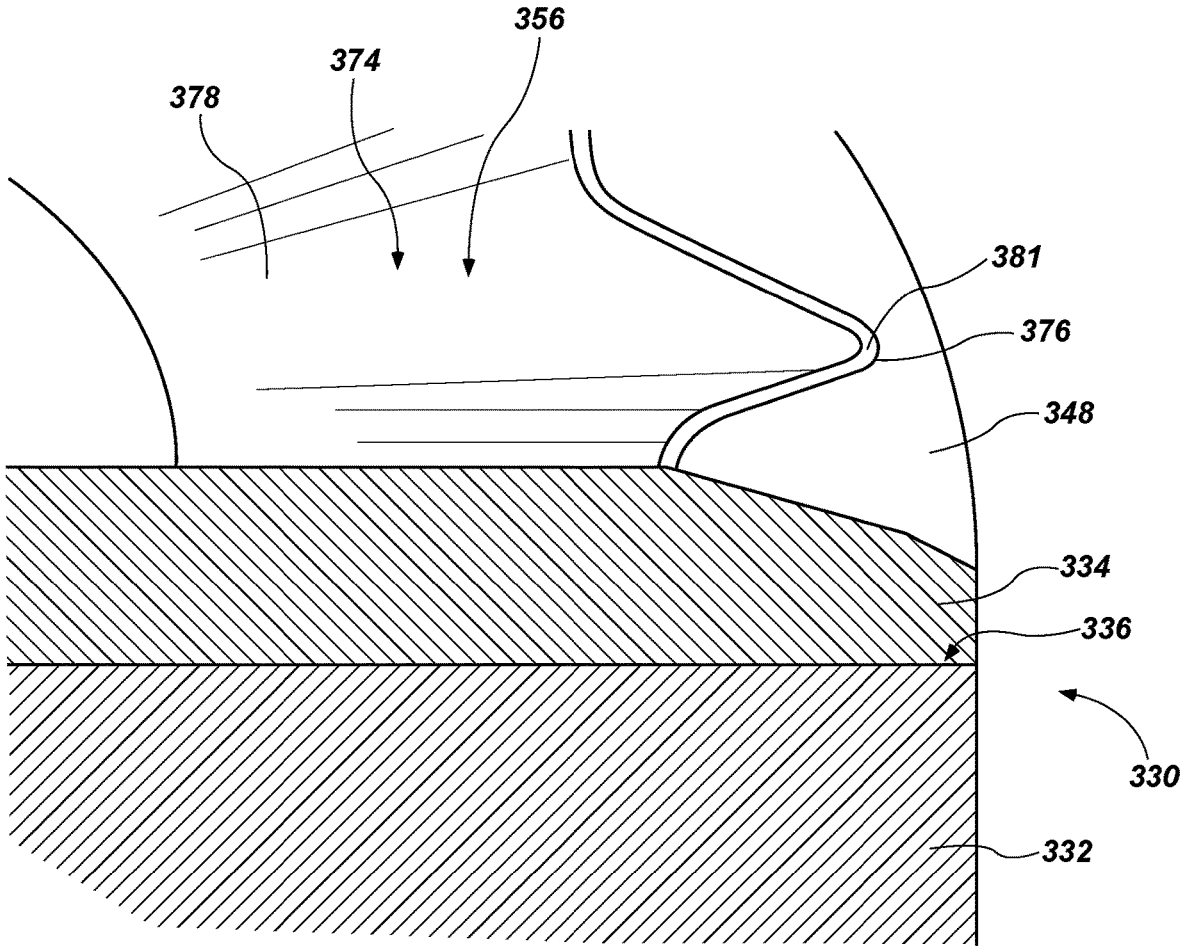
FIG. 6 is an enlarged side cross-sectional view of a cutting element according to one or more embodiments of the present disclosure.

FIG. 6 is an enlarged partial cross-sectional view of a cutting element 330 according to one or more embodiments of the present disclosure. As shown in FIG. 6, in some embodiments, the undulating edge 376 of the stress-reduction feature 356 may include an undulating chamfered edge 381. For example, the undulating edge 376 may include a third transition surface. Furthermore, the undulating chamfered edge 381 may extend from either the first transition surface 348 and/or the second transition surface 352 (depending on the embodiment) and to the surface 378 of the waveform 374. The undulating chamfered edge 381 may improve an overall durability of the stress-reduction feature 356, and as a result, the cutting element 330.

In some embodiments, a surface of the undulating chamfered edge 381 may define an acute angle with a plane to which the center longitudinal axis 350 of the cutting element 330 is normal within a range of about 10° and about 60° . In particular, the acute angle may be within a range of about 20° and about 50° . Additionally, a width of the undulating chamfered edge 381 (e.g., a width of the flat of the undulating chamfered edge 381) may be within a range of about 12.7 μm and about 0.51 mm. For instance, the width of the undulating chamfered edge 381 may be within a range of about 25.5 μm and about 130 μm.

In additional embodiments, the undulating chamfered edge 381 may include a curved surface. For example, in some embodiments, a radius of curvature of the undulating chamfered edge 381 between about 130 μm and about 1.3 mm. As a specific, non-limiting example, the radius of curvature of the undulating chamfered edge 381 may be, for example, between about 260 μm and about 1.3 mm (e.g., about 0.76 mm). In some embodiments, the width and/or the radius of curvature of the undulating chamfered edge 381 may vary in size throughout a length of the undulating chamfered edge (e.g., as the undulating chamfered edge 381 follows a contour of the waveform 374).

Figure 7:
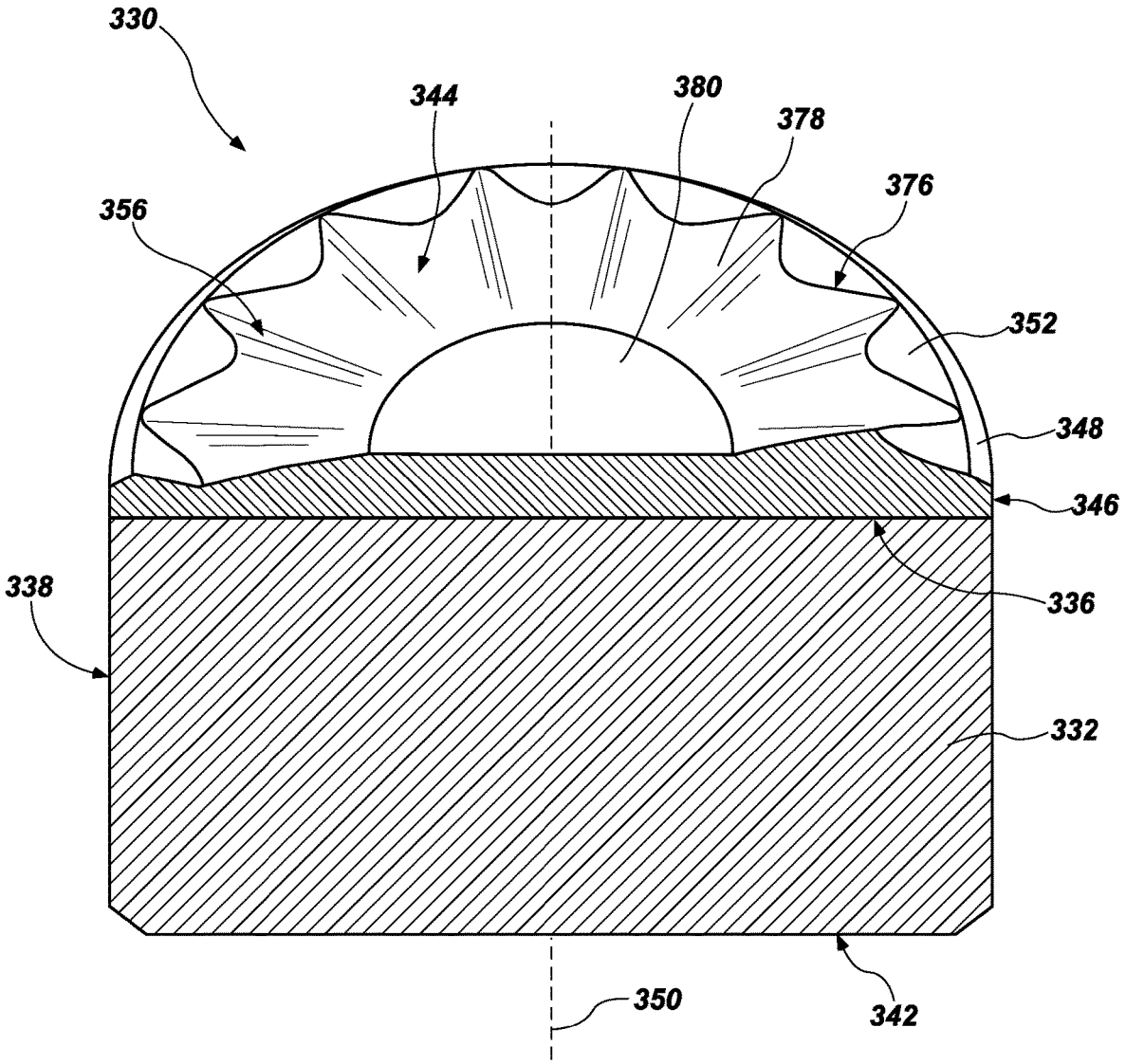
FIG. 7 is a cross-sectional view of a cutting element according to one or more embodiments of the present disclosure.

FIG. 7 is a partial cross-sectional view of a cutting element 330 according to one or more additional embodiments of the present disclosure. As shown in FIG. 7, in some embodiments, heights of the peaks of the surface 378 of the waveform 374 may vary. For instance, the peaks of the surface 378 of the waveform 374 may not be uniform in height or shape. In other words, the peaks of the surface 378 of the waveform 374 may be irregular and may vary from peak to peak. As a result, the troughs of the surface 378 may also be irregular and may vary from trough to trough. Having the peaks of the surface 378 of the waveform 374 be irregular may improve cuttings flow across the surface 378 of the waveform 374 during a drilling process. Furthermore, having the peaks of the surface 378 of the waveform 374 be non-uniform may enable an aggressiveness of the cutting element 330 to be tailored and to be varied across the cutting face 354 of the cutting element 330.

Figure 8:
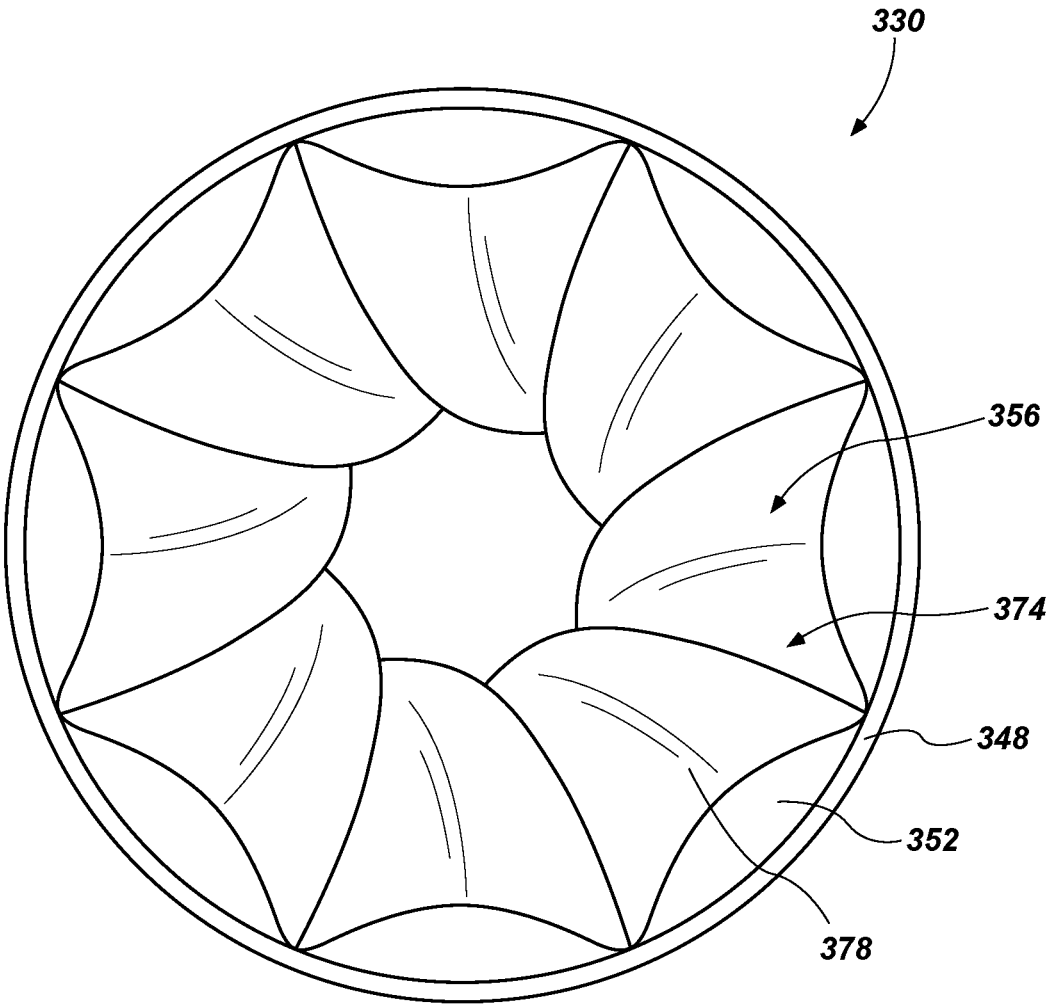
FIG. 8 is a front side view of another cutting element usable with the earth-boring tool of FIG. 2 according to one or more embodiments of the present disclosure.

FIG. 8 is a front view of a cutting element 330 according to one or more additional embodiments of the present disclosure. As shown in FIG. 8, in some embodiments, the stress-reduction feature 356 may include a waveform 374 have skewed waves. In some embodiments, the skewed waves may increase a flexural rigidity of the cutting face 354. The trough of the waves, if uninterrupted, may decrease a flexural resistance of the cutter face 354 in instances of excessive drilling loads. Curving, slanting, or skewing the waves to interrupt straight line connections between opposing troughs in the pattern may reduce a loss in flexural strength potentially experienced from completely symmetrical straight to center oriented wave elements (e.g., troughs and peaks). The curvature or slant can between about 10° and 30° to prevent a straight path to center, or between about 30° and 60° to create a ring type feature or pattern. The curvature or slant may be non-uniform across the all the wave features and may not extend completely to center but may still provide the above advantages. For instance, both the peaks and troughs of the waves of the waveform 374 may be irregular. For example, the waves of the waveform 374 may curve toward one or another lateral sides of the cutting element 330. Furthermore, in some embodiments, two troughs forming opposite sides of a single peak of the waveform 374 may have different shapes.

Figure 9A:
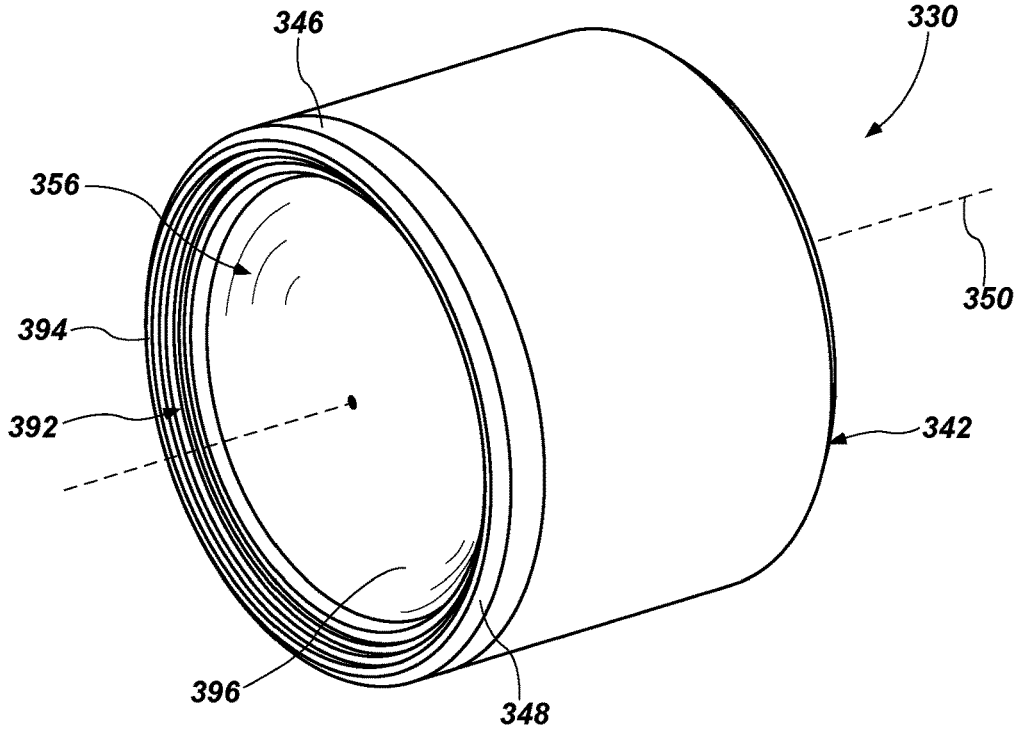
FIG. 9A is a perspective view of another cutting element usable with the earth-boring tool of FIG. 2 according to one or more embodiments of the present disclosure.
Figure 9B:
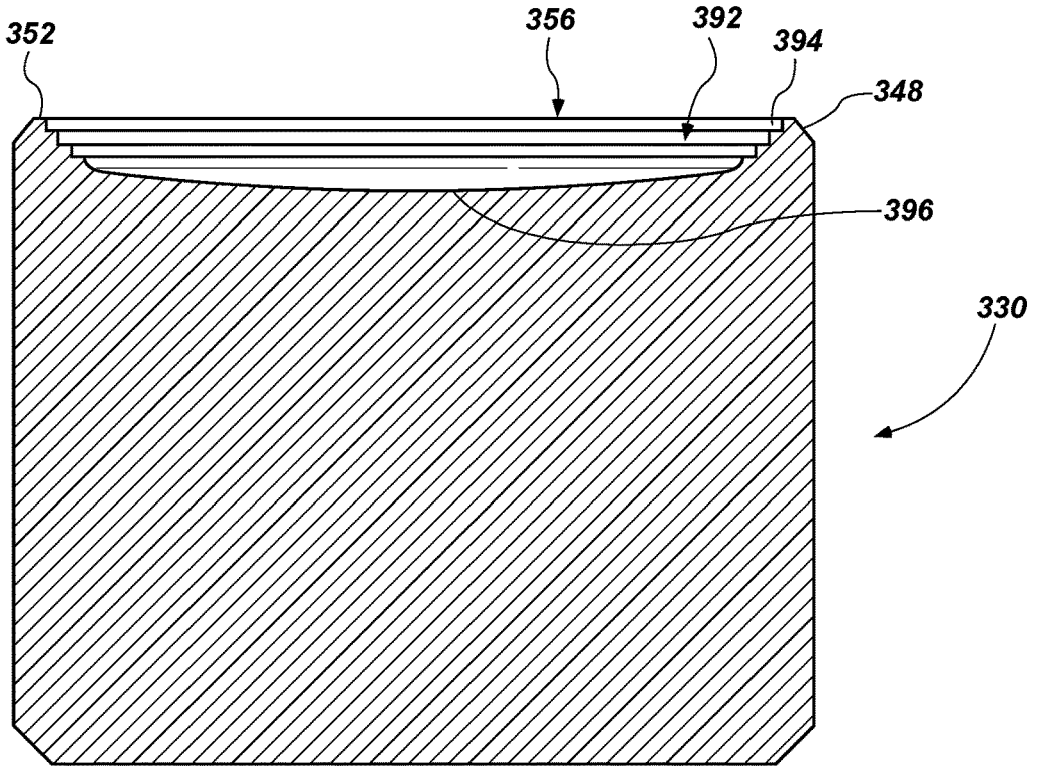
FIG. 9B is a side cross-sectional view of the cutting element of FIG. 9A.

FIG. 9A is a perspective view of a cutting element 330 according to one or more additional embodiments of the present disclosure. FIG. 9B is a cross-sectional view of the cutting element 330 of FIG. 9A. Referring to FIGS. 9A and 9B together, in some embodiments, the stress-reduction feature 356 may include a stair-stepped recess 392. Furthermore, the stair-stepped recess 392 may include a plurality of steps 394 extending in a descending orientation from either the first or second transition surfaces 348, 352 toward the center longitudinal axis 350 of the cutting element 330 and to a base surface 396 of the stress-reduction feature 356. In some embodiments, the base surface 396 may be farther axially from an uppermost surface of the cutting element 330 (as depicted in FIG. 9B) than the edge at the interface of the first transition surface 348 and the side surface 346 of the cutting element 330.

Figure 10A:
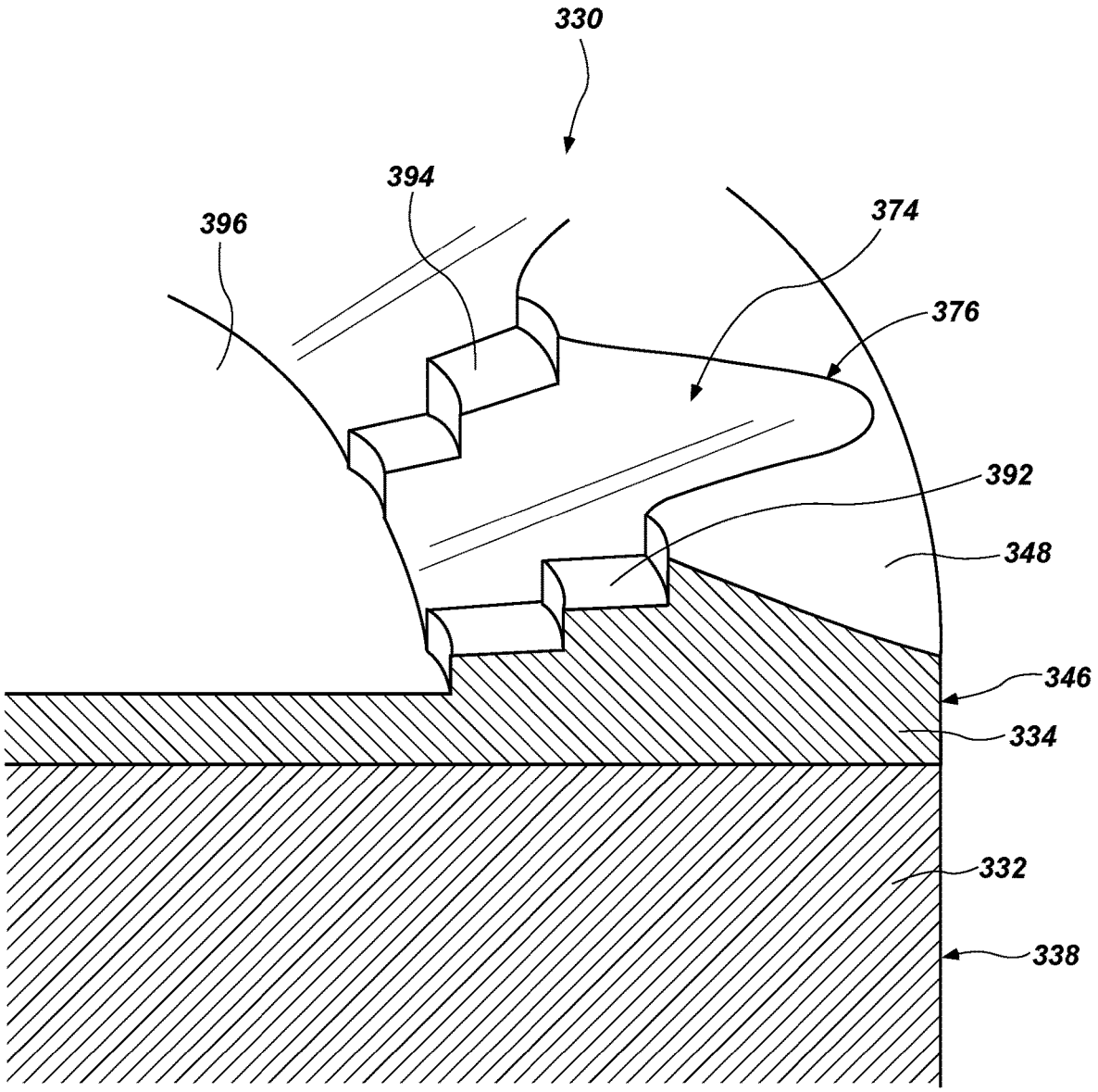
FIG. 10A is an enlarged partial cross-sectional view of a cutting element according to one or more embodiments of the present disclosure.
Figure 10B:
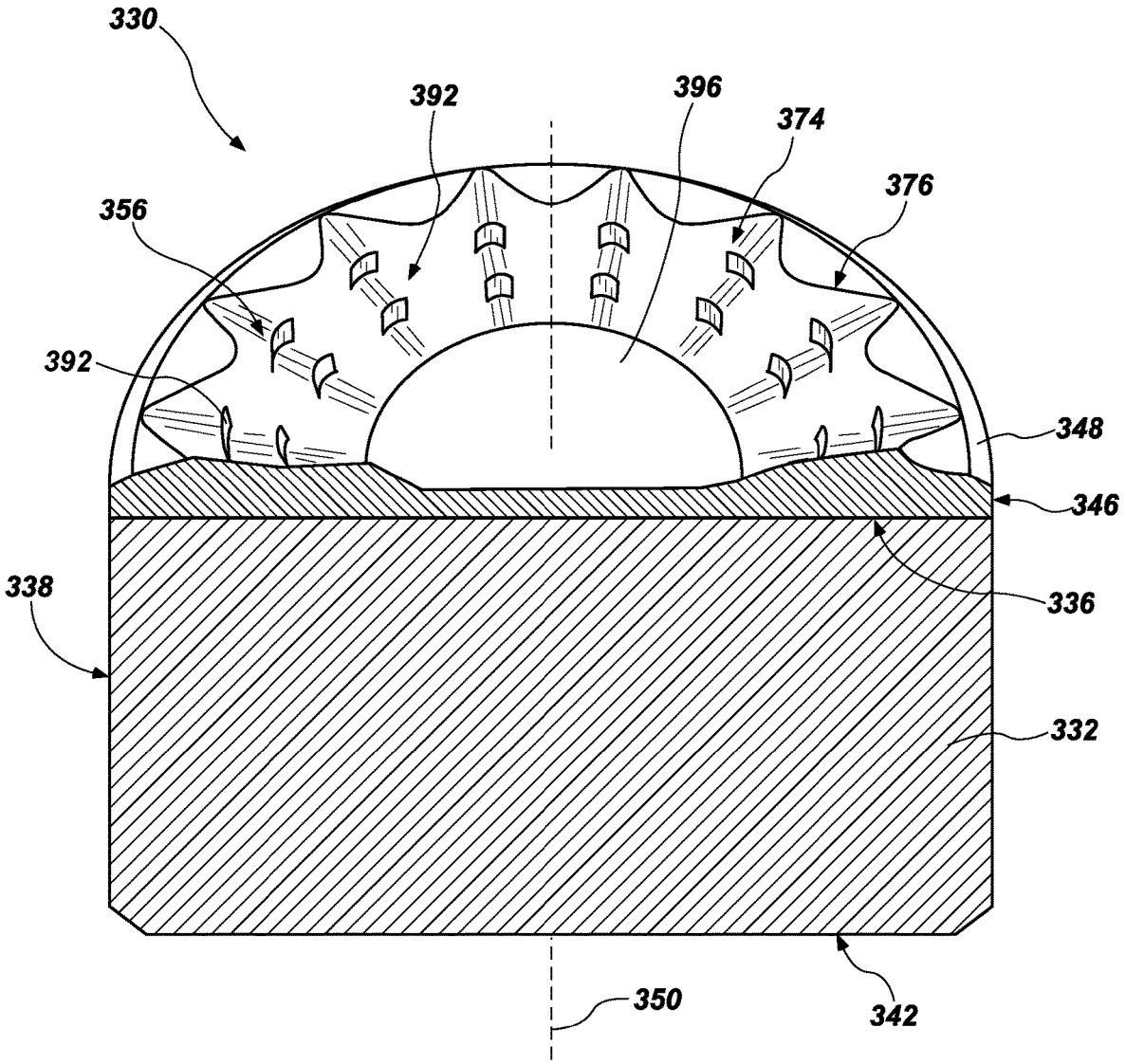
FIG. 10B is a side cross-sectional view of the cutting element of FIG. 10A.

In one or more embodiments, the base surface 396 may be planar. In other embodiments, the base surface 396 may include a convex or concave surface. In yet further embodiments, the base surface 396 may include any of the waveforms described above. Furthermore, embodiments of the present disclosure include waveforms having stair-stepped recesses formed therein, as shown in FIGS. 10A and 10B. Including a stair-stepped recess 392 within the stress-reduction feature 356 may reduce propagation of fractures on the waves (e.g., the faces of the waves) of the waveform 374 of the cutting face 354 of the cutting element 330. Furthermore, including a stair-stepped recess 392 in the stress-reduction feature 356 may provide chip breaking abilities to the cutting element 330. The stair-stepped recess 392 can limit and/or control fracture propagation within the stress-reduction feature 356.

Additional non limiting example embodiments of the disclosure are described below.

Embodiment 1: A cutting element for an earth-boring tool, comprising: a substrate; and a polycrystalline, superabrasive material secured to an end of the substrate, the polycrystalline, superabrasive material comprising: a first transition surface extending from an outer peripheral edge of the polycrystalline, superabrasive material and in a first direction oblique to a center longitudinal axis of the substrate; and a curved, stress-reduction feature located on at least the first transition surface.

Embodiment 2: The cutting element of embodiment 1, wherein the curved, stress-reduction feature comprises: an undulating edge formed in at least the first transition surface; and a waveform extending from the undulating edge formed in at least the first transition surface toward the center longitudinal axis of the cutting element.

Embodiment 3: The cutting element of embodiment 2, wherein a surface of the waveform positioned to engage with an underlying earth formation and extending radially from the first transition surface toward the center longitudinal axis is tapered toward the substrate, the surface of the waveform extending from the first transition surface to a planar surface of the polycrystalline, superabrasive material located at a same distance from the substrate as troughs of the waveform, the planar surface oriented perpendicular, and located proximate, to the center longitudinal axis.

Embodiment 4: The cutting element of embodiment 2, wherein a surface of the waveform positioned to engage with an underlying earth formation and extending radially from the first transition surface toward the center longitudinal axis is tapered away from the substrate, the surface of the waveform extending from the first transition surface to a planar surface of the polycrystalline, superabrasive material located at a same distance from the substrate as peaks of the waveform, the planar surface oriented perpendicular, and located proximate, to the center longitudinal axis.

Embodiment 5: The cutting element of embodiments 2-4, further comprising a second transition surface extending from the first transition surface and in a second direction oblique to the center longitudinal axis, the second direction being different from the first direction.

Embodiment 6: The cutting element of embodiment 5, wherein the undulating edge is formed in both the first transition surface and the second transition surface.

Embodiment 7: The cutting element of embodiments 5 and 6, wherein the second transition surface defines an acute angle with a plane to which the center longitudinal axis is normal within a range of about 0° and about 30° .

Embodiment 8: The cutting element of embodiments 2-7, a surface of the waveform positioned to engage with an underlying earth formation and extending radially from the first transition surface toward the center longitudinal axis extends to the center longitudinal axis.

Embodiment 9: The cutting element of embodiments 2-8, wherein the undulating edge comprises a chamfered undulating edge.

Embodiment 10: An earth-boring tool, comprising: a body; and a cutting element secured to the body, the cutting element comprising: a substrate; and a polycrystalline, superabrasive material secured to an end of the substrate, the polycrystalline, superabrasive material comprising: a first transition surface extending from an outer peripheral edge of the polycrystalline, superabrasive material and in a first direction oblique to a center longitudinal axis of the substrate; and a curved, stress-reduction feature located on at least the first transition surface and comprising: an undulating edge formed in at least the first transition surface; and a waveform extending from the undulating edge formed in at least the first transition surface toward the center longitudinal axis of the substrate.

Embodiment 11: The earth-boring tool of embodiment 10, wherein the waveform defines a plurality of peaks and a plurality of troughs.

Embodiment 12: The earth-boring tool of embodiment 11, wherein one or more of the plurality of peaks and one or more of the plurality of troughs of the waveform are skewed and curve toward a lateral side of the cutting element.

Embodiment 13: The earth-boring tool of embodiments 10-12, wherein the curved, stress-reduction feature further comprises a plurality of steps formed in the waveform and extending in a descending orientation from the first transition surface radially inward.

Embodiment 14: The earth-boring tool of embodiments 10-13, wherein a frequency of the waveform is between one every 180° and ten every 90° .

Embodiment 15: The earth-boring tool of embodiments 10-14, further comprising a second transition surface extending from the first transition surface and in a second direction oblique to the center longitudinal axis, the second direction being different from the first direction.

Embodiment 16: A method of forming a cutting element for an earth-boring tool, the method comprising: attaching a polycrystalline, superabrasive material to a substrate; forming a first transition surface to extend from an outer peripheral edge of the polycrystalline, superabrasive material and in a first direction oblique to a center longitudinal axis of the substrate; forming a curved, stress-reduction feature on at least the first transition surface, the curved, stress-reduction feature comprising: an undulating edge formed in at least the first transition surface; and a waveform extending from the undulating edge formed in at least the first transition surface toward the center longitudinal axis of the substrate.

Embodiment 17: The method of embodiment 16, further comprising forming a second transition surface to extend from the first transition surface and in a second direction oblique to the center longitudinal axis, the second direction being different from the first direction.

Embodiment 18: The method of embodiment 17, wherein forming a curved, stress-reduction feature comprises forming the undulating edge within both the first transition surface and the second transition surface.

Embodiment 19: The method of embodiments 17 and 18, wherein forming a second transition surface comprises forming the second transition surface to define an acute angle with a plane to which the center longitudinal axis is normal within a range of about 0° and about 20° .

Embodiment 20: The method of embodiments 17-19, wherein forming a curved, stress-reduction feature comprises forming the waveform to extend to the center longitudinal axis of the substrate.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A cutting element for an earth-boring tool, comprising:

a substrate; and a polycrystalline, superabrasive material secured to an end of the substrate, the polycrystalline, superabrasive material comprising:

a first transition surface extending from an outer peripheral edge of the polycrystalline, superabrasive material and in a first direction oblique to a center longitudinal axis of the substrate; and a curved, stress-reduction feature located on at least the first transition surface, the curved, stress reduction feature comprising:

an undulating edge formed in at least the first transition surface; and a waveform extending from the undulating edge formed in at least the first transition surface toward the center longitudinal axis of the substrate.

2. The cutting element of claim 1, wherein a surface of the waveform positioned to engage with an underlying earth formation and extending radially from the first transition surface toward the center longitudinal axis is tapered toward the substrate, the surface of the waveform extending from the first transition surface to a planar surface of the polycrystalline, superabrasive material located at a same distance from the substrate as troughs of the waveform, the planar surface oriented perpendicular, and located proximate, to the center longitudinal axis.

3. The cutting element of claim 1, wherein a surface of the waveform positioned to engage with an underlying earth formation and extending radially from the first transition surface toward the center longitudinal axis is tapered away from the substrate, the surface of the waveform extending from the first transition surface to a planar surface of the polycrystalline, superabrasive material located at a same distance from the substrate as peaks of the waveform, the planar surface oriented perpendicular, and located proximate, to the center longitudinal axis.

4. The cutting element of claim 1, further comprising a second transition surface extending from the first transition surface and in a second direction oblique to the center longitudinal axis, the second direction being different from the first direction.

5. The cutting element of claim 4, wherein the undulating edge is formed in both the first transition surface and the second transition surface.

6. The cutting element of claim 4, wherein the second transition surface defines an acute angle with a plane to which the center longitudinal axis is normal within a range of about 0° and about 30° .

7. The cutting element of claim 1, a surface of the waveform positioned to engage with an underlying earth formation and extending radially from the first transition surface toward the center longitudinal axis extends to the center longitudinal axis.

8. The cutting element of claim 1, wherein the undulating edge comprises a chamfered undulating edge.

9. An earth-boring tool, comprising:

a body; and a cutting element secured to the body, the cutting element comprising:

a substrate; and a polycrystalline, superabrasive material secured to an end of the substrate, the polycrystalline, superabrasive material comprising:

a first transition surface extending from an outer peripheral edge of the polycrystalline, superabrasive material and in a first direction oblique to a center longitudinal axis of the substrate; and a curved, stress-reduction feature located on at least the first transition surface and comprising:

an undulating edge formed in at least the first transition surface; and a waveform extending from the undulating edge formed in at least the first transition surface toward the center longitudinal axis of the substrate.

10. The earth-boring tool of claim 9, wherein the waveform defines a plurality of peaks and a plurality of troughs.

11. The earth-boring tool of claim 10, wherein one or more of the plurality of peaks and one or more of the plurality of troughs of the waveform are skewed and curve toward a lateral side of the cutting element.

12. The earth-boring tool of claim 9, wherein the curved, stress-reduction feature further comprises a plurality of steps formed in the waveform and extending in a descending orientation from the first transition surface radially inward.

13. The earth-boring tool of claim 9, wherein a frequency of the waveform is between one every 180° and ten every 90° .

14. The earth-boring tool of claim 9, further comprising a second transition surface extending from the first transition surface and in a second direction oblique to the center longitudinal axis, the second direction being different from the first direction.

15. A method of forming a cutting element for an earth-boring tool, the method comprising:

attaching a polycrystalline, superabrasive material to a substrate;

forming a first transition surface to extend from an outer peripheral edge of the polycrystalline, superabrasive material and in a first direction oblique to a center longitudinal axis of the substrate;

forming a curved, stress-reduction feature on at least the first transition surface, the curved, stress-reduction feature comprising:

an undulating edge formed in at least the first transition surface; and a waveform extending from the undulating edge formed in at least the first transition surface toward the center longitudinal axis of the substrate.

16. The method of claim 15, further comprising forming a second transition surface to extend from the first transition surface and in a second direction oblique to the center longitudinal axis, the second direction being different from the first direction.

17. The method of claim 16, wherein forming a curved, stress-reduction feature comprises forming the undulating edge within both the first transition surface and the second transition surface.

18. The method of claim 16, wherein forming a second transition surface comprises forming the second transition surface to define an acute angle with a plane to which the center longitudinal axis is normal within a range of about 0° and about 30° .

19. The method of claim 16, wherein forming a curved, stress-reduction feature comprises forming the waveform to extend to the center longitudinal axis of the substrate.

* * * * *